US005209778A

United States Patent [19]

Malloy

[11] Patent Number: 5,209,778

[45] Date of Patent: May 11, 1993

[54] HIGH SOLIDS CONTENT CALCIUM STEARATE DISPERSIONS

[75] Inventor: Patrick G. Malloy, Menasha, Wis.

[73] Assignee: PPG Industries, Inc., Pittsburgh, Pa.

[21] Appl. No.: 448,787

[22] Filed: Dec. 11, 1989

Related U.S. Application Data

[63] Continuation-in-part of Ser. No. 277,748, Nov. 30, 1988, abandoned.

[51] Int. Cl.[5] ..... C08L 91/00

[52] U.S. Cl. ..... 106/243

[58] Field of Search ..... 106/243, 199, 162; 162/175; 428/537.5, 537.7

[56] References Cited

U.S. PATENT DOCUMENTS

| | | | |
|---|---|---|---|
| 2,700,621 | 1/1955 | Schwalbe et al. | 117/65 |
| 3,532,647 | 10/1970 | Ritson et al. | 260/6 |
| 3,642,671 | 2/1972 | Lesinski | 260/9 |
| 3,891,580 | 6/1975 | Morris et al. | 260/8 |
| 3,932,192 | 1/1976 | Nakashio et al. | 106/204 |
| 4,329,177 | 5/1982 | George | 106/38.35 |
| 4,632,848 | 12/1986 | Gosset et al. | 427/154 |
| 4,659,489 | 4/1987 | Hill | 252/40.5 |
| 4,676,836 | 6/1987 | Hill et al. | 106/243 |

FOREIGN PATENT DOCUMENTS 2026001 1/1980 United Kingdom .

OTHER PUBLICATIONS

F. H. Frost et al., Starch & Starch Products in Paper Coating, pp. 108–113, 116.

Kirk-Othmer, Encyclopedia of Chemical Technology, 3rd ed., vol. 16, pp. 785–791.

Viscosity Control of Paper Coating Adhesives with Urea, J. R. Belche, Jr. et al., TAPPI, vol. 40, No. 2, Feb. 1957, pp. 94–99.

"Protein Binders in Paper and Paperboard Coating", TAPPI Monograph Series No. 36, pp. 27–29, 89–90, (1975).

*Primary Examiner*—Mark L. Bell

*Assistant Examiner*—Alan Wright

*Attorney, Agent, or Firm*—Edward J. Whitfield; Irwin M. Stein

[57] ABSTRACT

This invention relates to high solids content aqueous calcium stearate dispersions useful as lubricating agents in paper and paperboard coating compositions.

10 Claims, No Drawings

HIGH SOLIDS CONTENT CALCIUM STEARATE DISPERSIONS

CROSS REFERENCE TO RELATED APPLICATION

This is a continuation-in-part of copending application Ser. No. 07/277,748, filed Nov. 30, 1988 now abandoned.

BACKGROUND OF THE INVENTION

Aqueous calcium stearate dispersions have long been used as additives in paper coating formulation, the calcium stearate imparting lubricating, leveling and anti-dusting properties to the coating formulation.

Since it is preferable in the paper making industry to use as many predispersed starting materials as possible in preparing various coating formulations, it is advantageous to provide aqueous calcium stearate dispersions having as high a solids content as possible. Such advantages inure in lower shipping costs and introduction of less water into the coating formulation.

However, aqueous calcium stearate dispersions containing much above 50 weight percent solids do not retain desirable rheological properties, i.e., they are quite viscous and difficult to handle and meter.

High solids content calcium stearate compositions having workable viscosities are described in U.S. Pat. Nos. 4,659,489 and 4,676,836. U.S. Pat. No. 4,659,489 discloses high solids content, i.e., 50 to 75 weight percent, aqueous dispersions containing calcium stearate, dispersing agent, non-ionic lubricant and urea. U.S. Pat. No. 4,676,836 describes similar compositions, except that anionic lubricant is used in place of the non-ionic lubricant of U.S. Pat. No. 4,659,489.

THE INVENTION

This invention provides high solids content aqueous dispersion containing calcium stearate suitable for use as an additive in paper or paperboard coating formulations. More particularly, this invention provides aqueous calcium stearate dispersion having a solids content of from about 60 to about 80 weight percent, the balance being water. The solids portion of the dispersion comprises from about 35 to about 50 weight percent calcium stearate, from about 10 to about 40 weight percent urea and from about 5 to about 30 weight percent starch syrup. Preferred aqueous calcium stearate dispersion of this invention contains from about 60 to 70 weight percent solids, the balance being water; and the solids portion of the dispersion comprises from about 40 to 45 weight percent calcium stearate, from about 25 to 35 weight percent urea and from about 15 to about 25 weight percent starch syrup. Of course, the relative amount of each ingredient comprising the solids portion of the invention dispersion is selected so that the solids total 100 percent.

All of the components of the dispersion of the invention are staple items of commerce. For example, urea is commercially available in either liquid or solution form and calcium stearate is commercially available either in dry powdered form or in the form of aqueous dispersions. Preferred starting materials in accordance with the invention are solid urea and aqueous calcium stearate dispersion, the latter containing from about 40 to about 55 percent solids.

Aqueous calcium stearate dispersion is typically prepared by adding stearic acid to a vigorously stirred aqueous hydrated lime slurry in the presence of conventional, commercially available dispersing agent, such as polyalkoxylated alkyl or dialkyl phenol, e.g., polyethoxylated nonyl or dinonyl phenol. It is, of course, to be understood that the invention is not intended to be limited by any particular method of making aqueous calcium stearate dispersion containing from about 40 to about 55 weight percent solids, nor by any particular dispersing agent used to prepare such dispersion.

Starch syrup is typically commercially obtainable as a concentrated aqueous solution of partial hydrolyzates of starch and contains dextrose, maltose and high oligosaccharides derived from starch by acid or enzyme hydrolysis. Although starch syrup derived from corn starch is preferred for use in accordance with the invention, starch syrup derived from other vegetables, e.g., potatoes, may also be used. Starch syrup suitable for use in accordance with the invention typically has a density in the range of from about 41° to 45° Baume corresponding to a solids content of from about 76 to 84 weight percent.

In a preferred embodiment of this invention, high solids content aqueous calcium stearate dispersion is prepared by admixing urea and starch syrup in the desired amounts with aqueous calcium stearate dispersion containing from about 40 to about 55 weight percent solids. A particularly preferred commercially available aqueous calcium stearate dispersion is that made and sold by PPG Industries, Inc. under the trademark, "CALSAN TM 50". The CALSAN TM 50 material is an aqueous calcium stearate dispersion containing about 50 percent solids, and is prepared by reacting stearic acid with aqueous hydrated lime slurry in the presence of dispersing agent. The solids portion of the CALSAN TM 50 dispersion comprises about 88 to 90 percent calcium stearate. In accordance with this invention, a particularly preferred high solids content aqueous calcium stearate dispersion may be prepared by blending about 65 parts by weight of aqueous calcium stearate dispersion, containing about 50 weight percent solids (e.g., the aforementioned CALSAN TM 50 dispersion), with about 20 parts by weight of urea and about 15 parts by weight of corn syrup, the resulting dispersion having a solids content of about 65 weight percent, the balance being water. The solids portion of the dispersion comprises about 44 percent calcium stearate, about 31 percent urea and about 18 percent corn syrup.

The aqueous dispersions of the invention have, in addition to high solids content, workable viscosities which typically range from about 100 up to about 500 cps Brookfield at 60 rpm and are very compatible with conventional starch, protein or latex-type (e.g., styrene-butadiene, acrylic or polyvinyl acetate) paper coating compositions. The dispersions of the invention lubricate the coating in the wet state, providing improved flow and leveling characteristics and also permit increased steam usage during, e.g., supercalendaring operations to achieve desired gloss level by holding dusting to a minimum. Paper and paperboard sized with coatings incorporating the invention dispersions exhibit a smoother, more satinlike feel and texture, particularly after supercalendaring and are less likely to exhibit cracking after creasing or folding.

Although the invention has been described in some detail in the foregoing, it is to be understood that many variations may be made therein without departing from the spirit and scope thereof as defined by the appended claims.

I claim:

1. Aqueous calcium stearate dispersion having a solids content of from about 60 to about 80 weight percent, the balance being water, the solids portion of the dispersion consisting essentially of from about 35 to about 50 weight percent calcium stearate, from about 10 to about 40 weight percent urea and from about 5 to about 30 weight percent starch syrup.

2. Aqueous calcium stearate dispersion having a solids content of from about 60 to about 70 weight percent the balance being water, the solids portion consisting essentially of from about 40 to about 45 weight percent calcium stearate, from about 25 to about 35 weight percent urea and from about 15 to about 25 weight percent starch syrup.

3. Aqueous calcium stearate dispersion having a solids content of about 65 weight percent, the balance being water, the solids portion of the dispersion consisting essentially of about 44 weight percent calcium stearate, about 31 weight percent urea and about 18 weight percent corn syrup.

4. The calcium stearate dispersion of claim 1 wherein the starch syrup is derived from corn starch.

5. The calcium stearate dispersion of claim 4 wherein the starch syrup is corn syrup.

6. The calcium stearate dispersion of claim 4 wherein the Brookfield viscosity of the dispersion is from about 100 to 500 cps.

7. The calcium stearate dispersion of claim 2 wherein the starch syrup is derived from corn starch.

8. The calcium stearate dispersion of claim 7 wherein the starch syrup is corn syrup.

9. The calcium stearate dispersion of claim 7 wherein the Brookfield viscosity of the dispersion is from about 100 to about 500 cps.

10. The calcium stearate dispersion of claim 3 wherein the Brookfield viscosity of the dispersion is from about 100 to about 500 cps.

* * * * *